US009575455B2

(12) United States Patent
Hashimoto

(10) Patent No.: US 9,575,455 B2
(45) Date of Patent: Feb. 21, 2017

(54) DECOLORING DEVICE AND JAM DETECTION TIME CONTROLLING METHOD IN DECOLORING DEVICE

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotemba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/680,941

(22) Filed: Apr. 7, 2015

(65) Prior Publication Data

US 2016/0299465 A1 Oct. 13, 2016

(51) Int. Cl.
*G03G 15/00* (2006.01)

(52) U.S. Cl.
CPC ..... *G03G 15/70* (2013.01)

(58) Field of Classification Search
CPC ..... B41J 2202/37
USPC ..... 399/21
See application file for complete search history.

(56) References Cited

U.S. PATENT DOCUMENTS 6,633,401 B1 * 10/2003 Kojima ..... H04N 1/00204 358/1.1
7,480,466 B2 * 1/2009 Uchida ..... G03G 15/70 399/16
8,224,192 B2 * 7/2012 Watanabe ..... G03G 15/2064 399/21
8,899,855 B2 12/2014 Taki et al.
2005/0249511 A1 * 11/2005 Sekiguchi ..... G03G 15/70 399/20
2008/0095546 A1 * 4/2008 Abe ..... G03G 15/2028 399/21
2010/0118361 A1 * 5/2010 Iguchi ..... G03G 15/6529 359/33
2011/0222130 A1 * 9/2011 Iguchi ..... G03G 15/5062 358/452
2012/0038958 A1 * 2/2012 Iguchi ..... G03G 21/00 358/505

FOREIGN PATENT DOCUMENTS

JP 2010130372 6/2010

* cited by examiner

*Primary Examiner* — Anthony Nguyen
(74) *Attorney, Agent, or Firm* — Patterson & Sheridan, LLP

(57) ABSTRACT

A decoloring device according to an embodiment includes a decoloring unit configured to decolor an image on a sheet. A scanner optically reads the sheet and generates image data corresponding to the read sheet. A storage unit stores a first jam detection time and a second jam detection time, the second jam detection time being longer than the first jam detection time. A first sensor detects a sheet being transported in a first transport area. A second sensor detects a sheet being transported in a second transport area. A jam determination unit determines occurrence of a jam in the first transport area based on a detection by the first sensor compared to the first jam detection time, and determines occurrence of a jam in the second transport area based on a duration of a detection by the second sensor compared to the second jam detection time.

17 Claims, 6 Drawing Sheets

FIG. 4

| SHEET TYPE | FIRST JAM DETECTION TIME | RELATIONSHIP BETWEEN VARIABLES |
|---|---|---|
| BASIS WEIGHT: LESS THAN 64 $g/m^2$ | T1 | $0 < a < b < c < g$ |
| BASIS WEIGHT: 64-105 $g/m^2$ | T1 (1 − a/100) | |
| BASIS WEIGHT: 106-163 $g/m^2$ | T1 (1 − b/100) | |
| BASIS WEIGHT: 164-209 $g/m^2$ | T1 (1 − c/100) | |
| BASIS WEIGHT: 210-256 $g/m^2$ | T1 (1 − c/100) | |
| BASIS WEIGHT: 257 $g/m^2$- | T1 (1 − c/100) | |
| CLEAN PAPER | T1 (1 − g/100) | |

FIG. 5

| SHEET TYPE | NUMBER OF DE-COLORIZATION | SECOND JAM DETECTION TIME | RELATIONSHIP BETWEEN VARIABLES |
|---|---|---|---|
| BASIS WEIGHT: LESS THAN 64 g/m$^2$ | 0 | T2 | $0 < h < o < v$ |
| | 1 | T2 (1 + h/100) | |
| | 2 | T2 (1 + o/100) | |
| | ≥3 | T2 (1 + v/100) | |
| BASIS WEIGHT: 64-105 g/m$^2$ | 0 | T2 (1 − a/100) | $0 < a < i < p < w$ |
| | 1 | T2 (1 + i/100) | |
| | 2 | T2 (1 + p/100) | |
| | ≥3 | T2 (1 + w/100) | |
| BASIS WEIGHT: 106-163 g/m$^2$ | 0 | T2 (1 − b/100) | $0 < b < j < q < x$ |
| | 1 | T2 (1 + j/100) | |
| | 2 | T2 (1 + q/100) | |
| | ≥3 | T2 (1 + x/100) | |
| BASIS WEIGHT: 164-209 g/m$^2$ | 0 | T2 (1 − c/100) | $0 < c < k < r < y$ |
| | 1 | T2 (1 + k/100) | |
| | 2 | T2 (1 + r/100) | |
| | ≥3 | T2 (1 + y/100) | |
| BASIS WEIGHT: 210-256 g/m$^2$ | 0 | T2 (1 − c/100) | |
| | 1 | T2 (1 − c/100) | |
| | 2 | T2 (1 − c/100) | |
| | ≥3 | T2 (1 − c/100) | |
| BASIS WEIGHT: 257 g/m$^2$- | 0 | T2 (1 − c/100) | |
| | 1 | T2 (1 − c/100) | |
| | 2 | T2 (1 − c/100) | |
| | ≥3 | T2 (1 − c/100) | |
| CLEAN PAPER | 0 | T2 (1 − g/100) | $0 < g < u$ |
| | 1 | T2 (1 − g/100) | |
| | 2 | T2 (1 + u/100) | |
| | ≥3 | T2 (1 + u/100) | |

DECOLORING DEVICE AND JAM DETECTION TIME CONTROLLING METHOD IN DECOLORING DEVICE

FIELD

Embodiments described herein relate generally to a decoloring device and a jam detection time controlling method in a decoloring device.

BACKGROUND

A decoloring device performs decolorization processing by sequentially taking in a sheet on which an image is formed using a coloring agent which is decolored by heating at a predetermined temperature, and pressurizing and heating the sheet at a temperature of, for example, 180° C. to 200° C.

In the decoloring device, a scanner is provided to read a manuscript before the decolorization processing or to confirm a decolorized state after the decolorization processing. It is desirable to decrease a size of a decoloring device to use the decoloring device as part of an automatic document feeding (ADF) device of an image forming apparatus such as an MFP and the like.

In addition, when decreasing a size of the decoloring device, an interval between a decoloring unit and a scanner becomes narrow. For this reason, when a length of a sheet in a longitudinal direction is longer than the interval between the decoloring unit and the scanner (when the sheet spans across the scanner and the decoloring unit), a tip portion of the sheet reaches an inlet of the decoloring unit during read processing by the scanner. That is, it is possible to start the decolorization processing earlier than before.

However, when a sheet taken into the decoloring unit during the read processing by the scanner is jammed, the sheet stays at the decoloring unit in a high temperature state, and the sheet is decolorized before reading is completed. Therefore, it is not possible to save image data of a sheet before decolorization by re-feeding the sheet from a sheet feeding unit and performing the read processing again.

DESCRIPTION OF THE DRAWINGS

FIG. 4 illustrates an example of a first jam detection time table.

FIG. 5 illustrates an example of a second jam detection time table.

DETAILED DESCRIPTION

A decoloring device according to an embodiment includes a decoloring unit configured to decolor an image on a sheet. A scanner optically reads the sheet and generates image data corresponding to the read sheet. A storage unit stores a first jam detection time and a second jam detection time, the second jam detection time being longer than the first jam detection time. A first sensor detects a sheet being transported in a first transport area. A second sensor detects a sheet being transported in a second transport area. A jam determination unit determines occurrence of a jam in the first transport area based on a detection by the first sensor compared to the first jam detection time, and determines occurrence of a jam in the second transport area based on a duration of a detection by the second sensor compared to the second jam detection time.

Hereinafter, an exemplary embodiment will be described in detail with reference to drawings.

Figure 1:
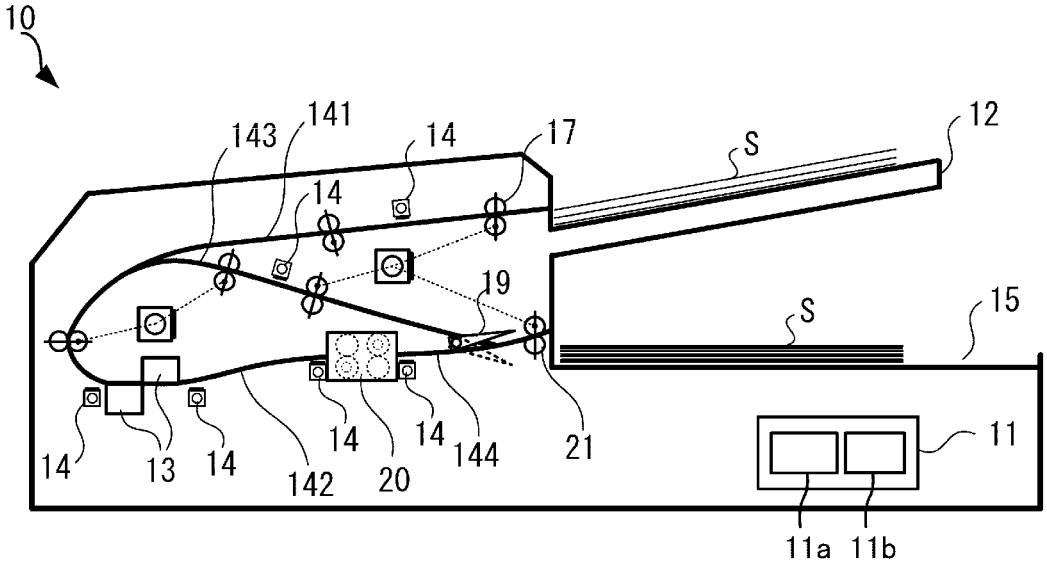
FIG. 1 is a schematic view which illustrates an overall configuration of a decoloring device according to an embodiment.

FIG. 1 is a schematic diagram which illustrates an overall configuration of a decoloring device 10 according to an embodiment. The decoloring device 10 includes a control panel 11, a sheet feeding tray 12, scanners 13, transmission sensors 14, a decoloring unit 20, and a sheet discharging tray 15.

The control panel 11 includes a display unit 11*a* which displays a function menu and the like, and a touch panel 11*b* which is an input unit for receiving input such as a user's erasure request or the like. The sheet feeding tray 12 stacks a sheet S to be read or decolored. The pair of scanner 13 optically reads an image formed on the sheet S when a reading job is performed, or before and after performance of decolorization processing, and stores the image in a storage region. Here, since the scanners 13 are each disposed on opposite sides of a transport path, it is possible to read both sides of the sheet S. The transmission sensors 14 are arranged along the transport path, and detect a transport state of the sheet S. The decoloring unit 20 decolors an image formed on the sheet S using a decolorable coloring agent. Here, with two sets of a heat roller and a pressure roller, it is possible to simultaneously decolor both sides by heat and pressure. The sheet discharging tray 15 stacks the sheet S after performing read processing or decolorization processing. Furthermore, the decoloring device 10 includes a first transport path 141, a second transport path 142, a third transport path 143, and a fourth transport path 144.

In each of the transport paths 141 to 144, a plurality of transport rollers 17 are provided for transporting the sheet S. Each transport roller 17 is driven by a motor 18.

The first transport path 141 transports the sheet S taken from the sheet feeding tray 12 to the scanner 13. The second transport path 142 transports the sheet S from the scanner 13 to the decoloring unit 20. The third transport path 143 transports the sheet S from the decoloring unit 20 to the second transport path 142. The fourth transport path 144 transports the sheet S from the decoloring unit 20 to the sheet discharging tray 15. Agate member 19 is positioned at an interchange point among the second transport path 142, the third transport path 143, and the fourth transport path 144. The gate member 19 may switch a transport destination of the sheet S.

The decoloring device 10 performs the following operations (1) to (5) in general.

(1) The scanner 13, for example, reads image data before decoloring an image on a sheet S. The image data read by the scanner 13 is saved in a storage device. Furthermore, the scanner reads a marking printed on the sheet indicating the number of decolorization processing that the sheet has been subject to, and the number of decolorization processing of the reading sheet is acquired.

(2) The sheet S transported to the decoloring unit 20 is heated and pressurized when passing through the decoloring unit 20. The decoloring unit 20 heats and pressurizes the sheet S at a relatively high temperature of, for example, 180° C. to 200° C. to decolor an image on the sheet S.

(3) The sheet S passing through the decoloring unit 20 is transported again to the scanner 13. The scanner 13 reads an image on the sheet after decolorization processing so as to confirm whether the image formed using the decolorable coloring agent in an image region is completely decolored.

(4) A decolorization state is determined by analyzing image data of a sheet read by the scanner 13. A determination result is displayed on the control panel 11.

(5) The sheet after decoloring is discharged to the sheet discharging tray 15 by driving a sheet discharging roller 21.

"Decoloring" in the present embodiment means to make visually invisible an image formed in a color (including not only a chromatic color but also achromatic color such as white, black, and the like) which is different from a background color of the sheet. Here, "make visually invisible" may be an operation in which an image formed in a color different from the background color of the sheet is color-changed to a color the same as or similar to the background color of the sheet in addition to an operation in which the image formed in a color different from the background color of the sheet becomes colorless (transparent).

Figure 2:
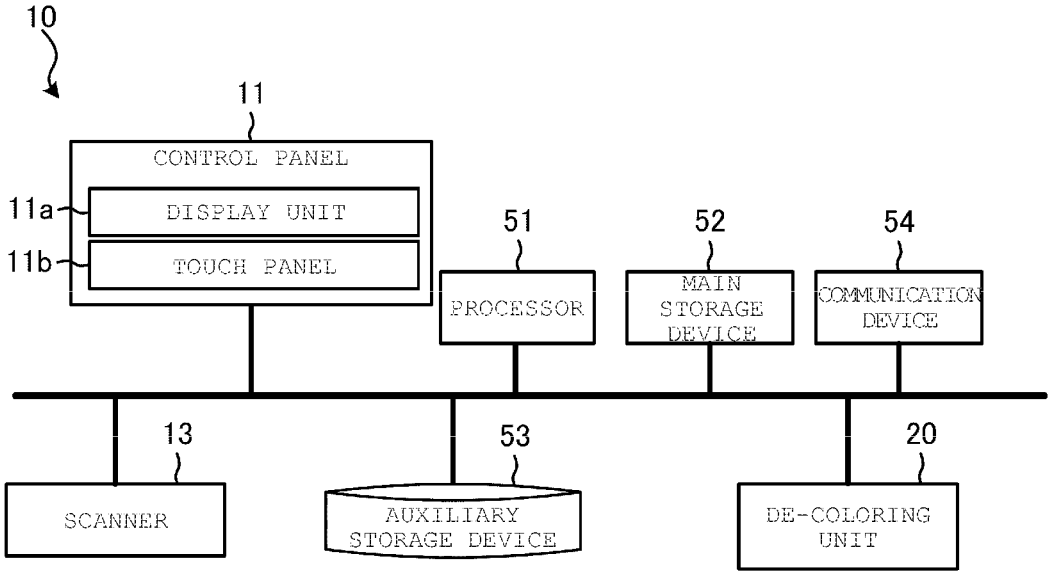
FIG. 2 is a block diagram illustrating a hardware configuration of the decoloring device.

FIG. 2 is a block diagram which illustrates an example hardware configuration of the decoloring device 10. As illustrated in the figure, the decoloring device 10 includes (in addition to the control panel 11, the scanner 13, and the decoloring unit 20 described above) a processor 51, a main storage device 52, an auxiliary storage device 53, and a communication device 54. The processor 51 is a Central Processing Unit (CPU) which controls the decoloring device 10 as a whole. The main storage device 52 is a Read Only Memory (ROM) which stores a basic program, an environment file, or the like which causes a computer to function, or a Random Access Memory (RAM) which stores a program executed by a processor 51 and data necessary for execution of each program. The auxiliary storage device 53 is a storage device such as a Hard Disk Drive (HDD) or the like. The auxiliary storage device 53 stores data regarding the usage state of the decoloring device 10, scanned image data to save as a backup of a document before executing decolorization processing, and various types of programs and data which operate in a control system of the decoloring device 10. The communication device 54 transmits or receives information to or from a separate computer (not illustrated) connected through a network.

Figure 3:
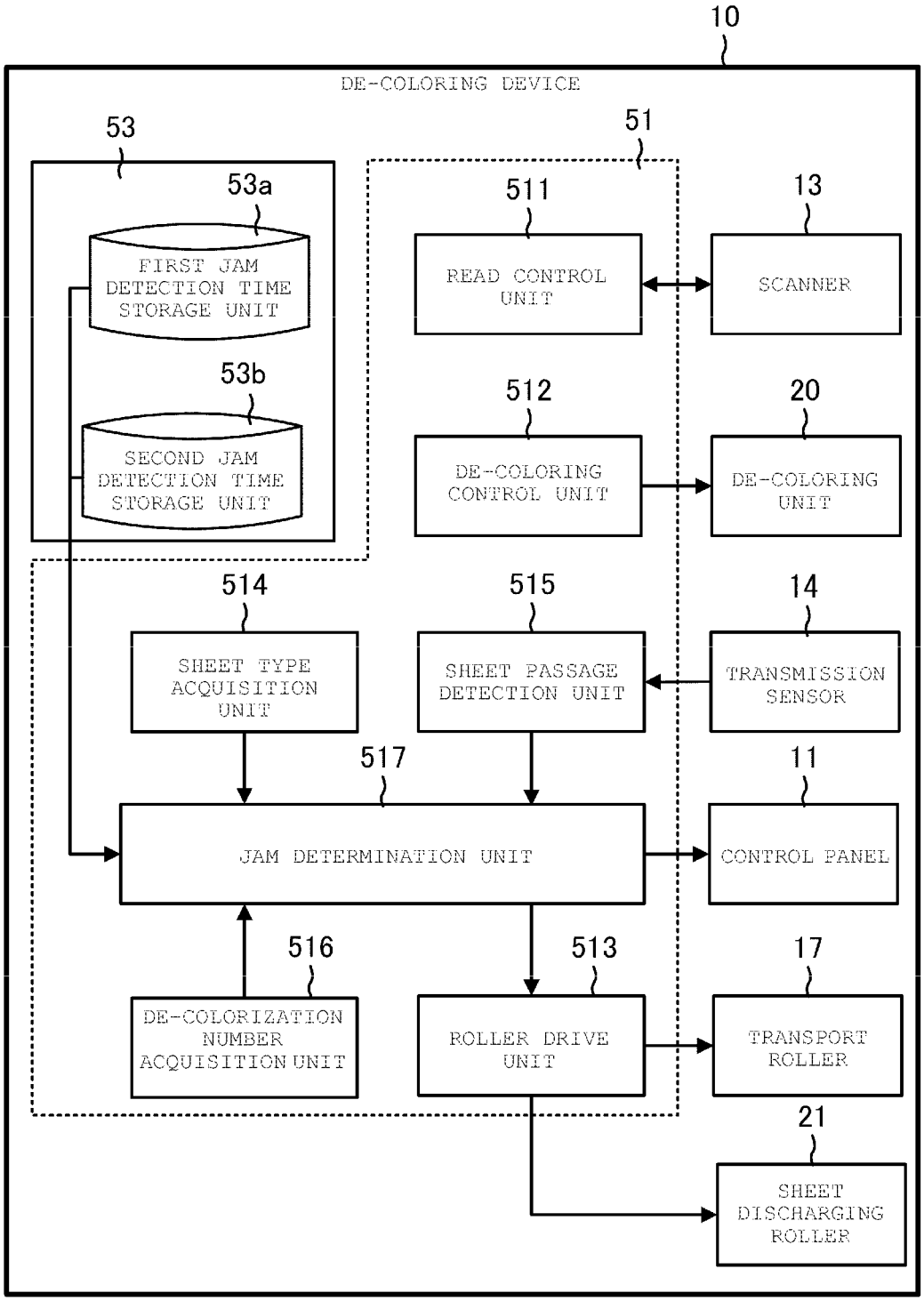
FIG. 3 is a block diagram illustrating a control system of the decoloring device.

FIG. 3 is a block diagram which illustrates an example configuration of the decoloring device 10. Here, the auxiliary storage device 53 includes a first jam detection time storage unit 53*a* and a second jam detection time storage unit 53*b*. The first jam detection time storage unit 53*a* stores a jam detection time (hereinafter, referred to as "a first jam detection time") in a transport path (hereinafter, referred to as "a first transport area") on the further upstream side in the transport direction than the inlet of the decoloring unit 20 among transport paths. In an example of FIG. 1, the transmission sensors 14 are respectively positioned near both ends of the decoloring unit 20. Therefore, a position of the transmission sensor 14 on the scanner 13 side is considered as the inlet of the decoloring unit 20 in the embodiment.

FIG. 4 is a diagram which illustrates a specific example of a first jam detection time storage unit 53*a*. Here, a sheet type is classified according to a value of a basis weight, and the first jam detection time is defined for each sheet type. For example, it is illustrated that, in a case of a sheet type in which a basis weight is less than 64 g/m$^2$, the first jam detection time of the sheet in the first transport area is T1 (seconds). In addition, a relationship ($a<b<c<g$) between variables a, b, c, and g is defined so that the first jam detection time becomes shorter as the basis weight increases until the basis weight reaches a predetermined upper limit (209 g/m$^2$).

Hereinafter, a reason to define the first jam detection time as described above will be described in detail. First, a relationship between the basis weight of a sheet and tendency of a jam will be described. In general, a sheet whose basis weight is large is thick in sheet thickness and has a high stiffness, such that a jam rarely occurs during a transport of the sheet. On the other hand, a sheet whose basis weight is small is thin in sheet thickness and has a weak body, such that a jam is likely to occur during a transport of the sheet.

Then, a relationship between the basis weight of a sheet and a jam detection time will be described. When a jam detection time is set to be short, a sheet (a sheet whose basis weight is small) on which a jam easily occurs may be erroneously determined as having a jam even if the sheet is not in a jam state. Thus, it is necessary to set a jam detection time to be longer for the sheet on which a jam easily occurs (a sheet whose basis weight is small) than a sheet (sheet whose basis weight is large) on which a jam rarely occurs.

On the other hand, it is necessary to set a jam detection time to be shorter for a sheet whose basis weight is large compared to a sheet whose basis weight is small. This is because, as described above, the sheet whose basis weight is large is thick in sheet thickness and has a high stiffness, such that a jam rarely occurs during a transport of a sheet. Therefore, even when setting jam detection time thereof to be shorter than a jam detection time of a sheet whose basis weight is small, there is less possibility to erroneously detect the occurrence of a jam.

Since the sheet whose basis weight is large has a high stiffness, when having a jam, the damage to the sheet is greater than the damage to a sheet which has a weak stiffness. For this reason, it is necessary to early detect a jam state of the sheet whose basis weight is large. Therefore, it is effective to set a jam detection time to be short for the sheet whose basis weight is large. However, when a basis weight is equal to or more than a predetermined upper limit, there is no necessity for further division. Thus, in such cases, the jam detection time is defined to be a given value.

The second jam detection time storage unit 53*b* stores a jam detection time (hereinafter, referred to as "a second jam detection time") in a transport path (hereinafter, referred to as "a second transport area") on a further downstream side in the transport direction than the inlet of the decoloring unit 20 among transport paths. The second jam detection time is defined to be longer than the first jam detection time. Hereinafter, a reason for defining the jam detection times as described above will be described in detail. When a tip end side of a sheet during reading by the scanner 13 enters the second transport area, decolorization processing by the decoloring unit 20 is started. In this case, a portion of an image on the tip end side of the sheet is decolored; however, an image at a rear end side of the sheet is still in the scanner 13 (read unit), and read processing of reading images on an entire sheet is not completed. In this state, when the sheet is jammed and a sheet transport is stopped, a portion of an image on the sheet is decolored. For this reason, even if a sheet is set in the sheet feeding unit (sheet feeding tray 12) again and re-reading is performed, it is not possible to save an image of an entire surface of the sheet before decolorization processing as electronic data. In order to prevent such a situation, when the sheet enters the second transport area (that is, a tip end of the sheet reaches the decoloring unit), a jam detection time in the second transport area is set to be the second jam detection time which is longer than the first jam detection time, whereby a jam is rarely detected. In this manner, it is possible to reduce occurrence of a situation in which an image on the entire surface of a sheet may not be saved because the sheet is jammed and a sheet transport is stopped with a portion of an image on the sheet decolored.

FIG. 5 is a diagram which illustrates a specific example of a second jam detection time storage unit 53*b*. Here, the second jam detection time is defined with respect to a combination of a sheet type and the number of times the sheet has been subject to decolorization. For example, it is illustrated that, when a sheet type is a sheet type in which basis weight is less than 64 g/m$^2$ and the number of decolorization times is zero, the second jam detection time of a sheet in the second transport area is T2. Moreover, each relationship of variables ($0<h<o<v$, $0<a<i<p<w$, $0<b<j<q<x$, $0<g<u$) is defined so that the second jam detection time becomes longer as the number of decolorization times increases until the number of decolorization times reaches a predetermined upper limit of the number of decolorization times (three) for the same sheet type. A reason for defining the relationship as described above is because it is assumed that as the number of decolorization times increases, stiffness of a sheet becomes weak and a jam is likely to occur during a transport of the sheet. As a result, when considering a relationship between stiffness of a sheet and a jam detection time described with reference to FIG. 4, a long jam detection time is required as the number of decolorization times increases. However, when the number of decolorization is equal to or more than the predetermined number of times, subsequent changes in the stiffness of a sheet are small. Therefore, when the number of decolorization times is equal to or more than the predetermined number of times, the jam detection time is defined to a constant value.

In a case of the same number of decolorization times, the second jam detection time becomes shorter as a basis weight increases until the basis weight reaches a predetermined upper limit (209 g/m$^2$). In FIGS. 4 to 5, for convenience of description, the jam detection time is expressed by a formula which contains variables. However, the jam detection time may be defined by a specific numerical value.

Moreover, as illustrated in FIG. 3, the processor 51 is configured by a control system program to include: a read control unit 511, a decoloring control unit 512, a roller drive unit 513, a sheet type acquisition unit 514, a sheet passage detection unit 515, a decolorization number acquisition unit 516, and a jam determination unit 517.

The read control unit 511 controls read processing by the scanner 13 and saves image data in the auxiliary storage device 53. The decoloring control unit 512 controls a power supply to a heat source in a heat roller or a drive of the heat roller and a pressure roller of the decoloring unit 20. The roller drive unit 513 controls electric conduction to the plurality of motors 18, respectively, and drives the transport roller 17 and the sheet discharging roller 21.

The sheet type acquisition unit 514 determines a sheet type of a sheet which is taken or has been taken into the device from the sheet feeding tray 12, and outputs a result of the determination to the jam determination unit 517. Examples of a determination method include: (1) a method of referring to setting information of a sheet selected by a user in the control panel 11, and (2) a method of detecting a thickness and a length of a sheet using a predetermined sensor when taking a sheet, and referring to a correspondence table based on a result of the detection.

The sheet passage detection unit 515 detects a passage of a sheet in the transport paths 141 to 144 based on a detection result from the plurality of transmission sensors 14 disposed in the transport paths 141 to 144. When the transmission sensors 14 detect a sheet, the transmission sensors 14 are in an ON state. When the sheet is passed through, the transmission sensors 14 return to be an OFF state. An elapsed time while each sensor is in an ON state is compared with a reference time of jam detection (the first jam detection time and the second jam detection time).

The decolorization number acquisition unit 516 analyzes a mark formed on a sheet related to the number of decolorization times, acquires the number of decolorization times of the sheet, and outputs a result of the acquisition to the jam determination unit 517.

When a transport position (current position) of a sheet is in the first transport area, the jam determination unit 517 acquires the first jam detection time from the first jam detection time storage unit 53*a* based on a sheet type. In addition, when the transport position of a sheet is in the second transport area, the jam determination unit 517 acquires the second jam detection time from the second jam detection time storage unit 53*b* based on a sheet type and the number of decolorization. Then, the jam determination unit 517 determines a presence or absence of the occurrence of a jam based on a detection result of the transmission sensors 14 and the first jam detection time or the second jam detection time. That is, when the sheet is positioned in the first transport area, the jam determination unit 517 determines the occurrence of a jam based on the first jam detection time and a detection result (elapsed time in the ON state) of the transmission sensors 14. When the sheet is positioned in the second transport area, the jam determination unit 517 determines the occurrence of a jam based on the second jam detection time and a detection result of the transmission sensors 14. A reference time is switched from the first jam detection time to the second jam detection time when the sheet reaches the inlet of the decoloring unit 20.

Figure 6:
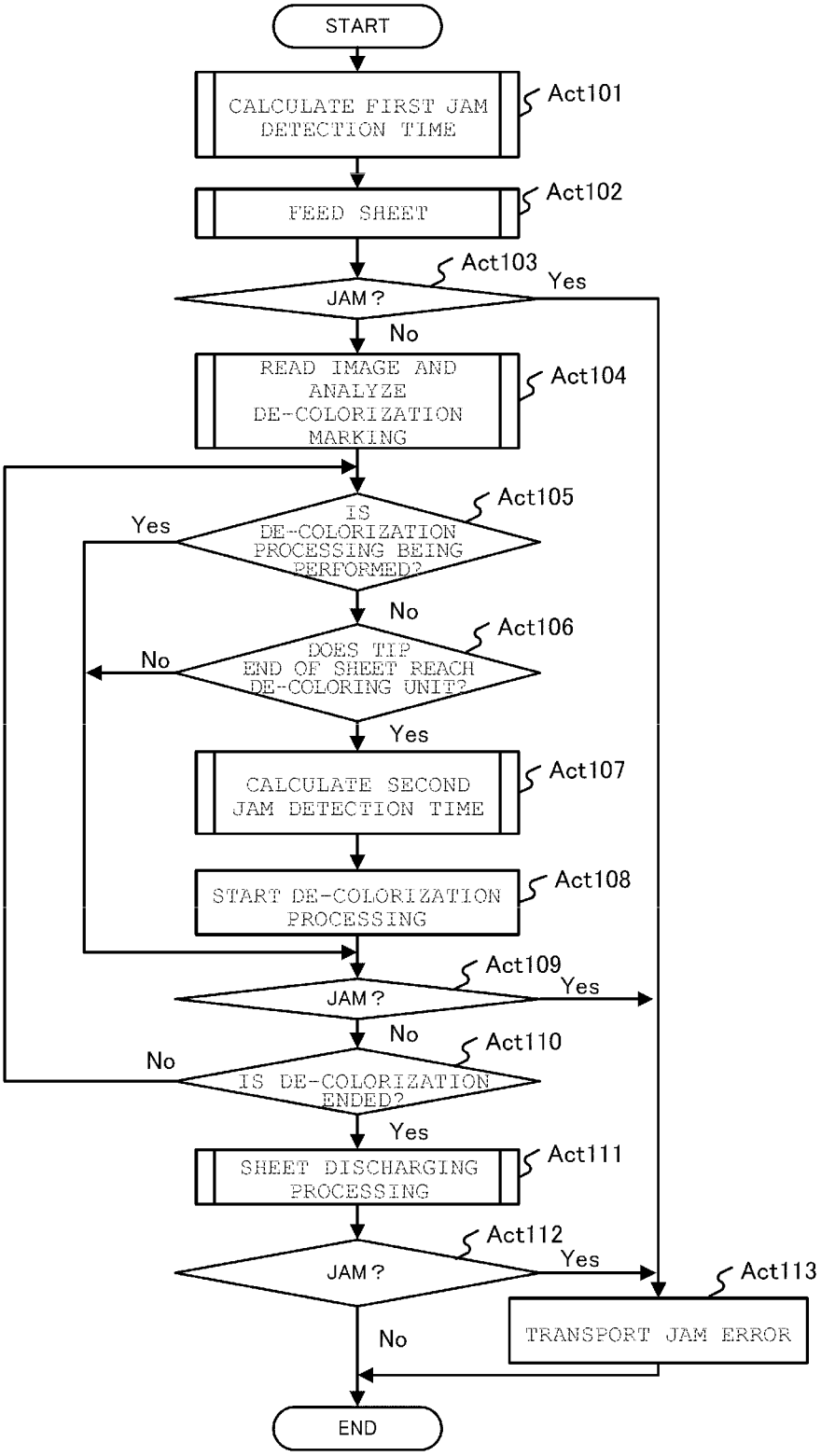
FIG. 6 is a flowchart which illustrates an example sequence of operations in the decoloring device.

Subsequently, an operation of the decoloring device 10 configured as described above will be described with reference to drawings. FIG. 6 is a flowchart which illustrates an example sequence of operations in the decoloring device 10. This processing is performed on a sheet basis.

When a decoloring job is input from the control panel 11, the jam determination unit 517 performs first jam detection time calculation processing (Act 101), and stores the calculated first jam detection time in a storage region such as the main storage device 52 and the like. This processing will be described in detail below.

Then, the roller drive unit 513 feeds a sheet into the first transport path 141 by driving the transport roller 17 disposed in a vicinity of the sheet feeding tray 12 (Act 102). The sheet is led toward the scanner 13 by the first transport path 141 and the transport roller 17. Moreover, during a transport of the sheet, the sheet passage detection unit 515 counts the elapsed time in the ON state in a sensor position for each of the transmission sensors 14 while acquiring a transport position of the sheet in real time.

Then, the jam determination unit 517 compares a transport elapsed time in the first transport area with the first jam detection time, and determines whether a jam occurs in the first transport path 141 (Act 103). Here, when it is determined that a jam occurs (Yes in Act 103), the procedure proceeds to Act 113. When it is determined that a jam does not occur (No in Act 103), the procedure proceeds to Act 104.

In Act 104, the read control unit 511 activates the scanner 13, performs read processing of an image formed on the sheet, and at the same time, analyzes a mark related to the number of decolorization times included in created image data to acquire the number of decolorization times of the sheet.

In Act 105, the sheet passage detection unit 515 determines whether decolorization processing is being performed based on a transport position of the sheet. Here, when it is determined that the decolorization processing is being performed (Yes in Act 105), the procedure proceeds to Act 109. When it is determined that the decolorization processing is not being performed (No in Act 105), the procedure proceeds to Act 106.

In Act 106, the sheet passage detection unit 515 determines whether a tip end portion of the sheet reaches the inlet of the decoloring unit 20. Specifically, the sheet passage detection unit determines whether the transmission sensor 14 disposed in a vicinity of the inlet of the decoloring unit 20 detects the sheet. Here, when it is determined that the tip end portion of the sheet reaches the inlet of the decoloring unit 20 (Yes in Act 106), the procedure proceeds to Act 107. When it is determined that the tip end portion of the sheet does not reach the inlet of the decoloring unit 20 (No in Act 106), the procedure proceeds to Act 109.

In Act 107, the jam determination unit 517 performs second jam detection time calculation processing and stores the calculated second jam detection time in a storage region. The processing will be described in detail below.

In Act 108, a decoloring control unit 512 starts decolorization processing for a sheet.

In Act 109, the jam determination unit 517 determines whether a jam occurs in the first transport area before starting decoloring and determines whether a jam occurs in the second transport area after decolorization processing. Here, when the jam determination unit determines that a jam occurs (Yes in Act 109), the procedure proceeds to Act 113. When determining that a jam does not occur (No in Act 109), the procedure proceeds to Act 110.

In Act 110, the decoloring control unit 512 determines whether the decolorization processing is ended based on a transport position of the sheet. Specifically, the decoloring control unit 512 determines whether a signal state is changed to a signal state in which both of the transmission sensors 14 are turned off from a signal state in which the transmission sensor 14 in a vicinity of the inlet of the decoloring unit 20 is turned off and the transmission sensor 14 in a vicinity of an outlet of the decoloring unit 20 is turned on due to a rear end portion of the sheet passing through the decoloring unit 20. Here, when it is determined that the decolorization processing is ended (Yes in Act 110), the roller drive unit 513 drives the transport roller 17 disposed in the fourth transport path 144, and starts sheet discharge processing (Act 111), and the procedure proceeds to Act 112. In contrast, when it is determined that the decolorization processing is not ended (No in Act 110), the procedure returns to Act 105. The processings of Act 105 to Act 110 are repeated until the decolorization processing is ended.

In Act 112, the jam determination unit 517 determines whether a jam occurs in the second transport area. Here, when it is determined that a jam occurs (Yes in Act 112), the procedure proceeds to Act 113. When it is determined that a jam does not occur (No in Act 112), the processing is ended.

In Act 113, the jam determination unit 517 displays a transport jam error on the control panel 11 (display unit 11*a*), and ends the processing. The error message includes information which identifies a transport path in which the jam occurs.

Figure 7:
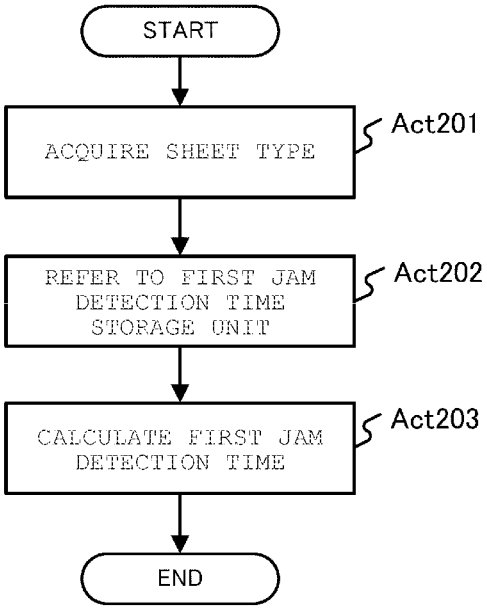
FIG. 7 is a flowchart which illustrates an example sequence of operations of Act 101 of FIG. 6.

FIG. 7 is a flowchart which illustrates an example sequence of operations of Act 101 of FIG. 6.

First, the sheet type acquisition unit 514 acquires a sheet type from sheet setting information stored in the auxiliary storage device 53 in advance (Act 201), and outputs the acquired sheet type to the jam determination unit 517.

Then, the jam determination unit 517 refers to the first jam detection time storage unit 53*a* based on the sheet type (Act 202) to acquire a calculation formula of the first jam detection time.

Then, the jam determination unit 517 calculates the first jam detection time based on a calculation formula and a reference value T1 in the first transport area (Act 203), and stores the calculated first jam detection time in the storage region to end the processing. When a specific value is set as the second jam detection time in the first jam detection time storage unit 53*a*, this processing is not performed.

Figure 8:
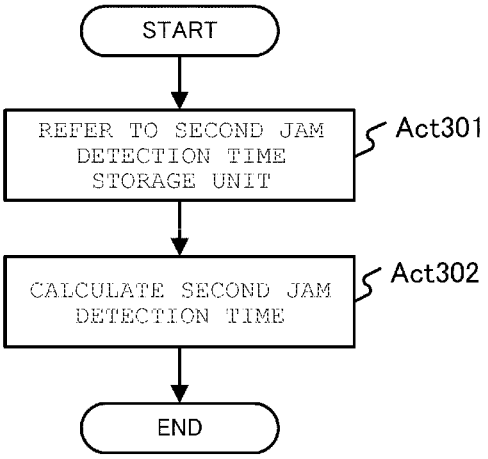
FIG. 8 is a flowchart which illustrates an example sequence of operations of Act 107 of FIG. 6.

FIG. 8 is a flowchart which illustrates an example sequence of operations of Act 107 of FIG. 6.

First, the jam determination unit 517 acquires a calculation formula of the second jam detection time based on the combination of the sheet type acquired in Act 201 of FIG. 7 and the number of decolorization times acquired in Act 105 of FIG. 6 with reference to the second jam detection time storage unit 53*b* (Act 301).

Then, the jam determination unit 517 calculates the second jam detection time based on a reference value T2 in the second transport area and the calculation formula (Act 302), and stores the result in a storage region to end the processing. When a specific value is set as the second jam detection time in the second jam detection time storage unit 53*b*, this processing is not performed.

According to the decoloring device 10 according to the embodiment, the second jam detection time in an area (second transport area) after the decoloring unit 20 is defined to be longer than the first jam detection time in an area (first transport area) before the decoloring unit 20. In addition, the first jam detection time and the second jam detection time may be updated according to a sheet type of a sheet which is fed. Then, when the tip end portion of the sheet is taken into the decoloring unit 20, a determination criterion of a jam is automatically switched from the first jam detection time to the second jam detection time.

Thus, when detection time (elapsed time in an ON state) of the transmission sensors 14 in the second transport area does not exceed the second jam detection time, a jam is not detected even when decolorization processing is started before read processing is completed. As a result, it is possible to avoid a situation in which a sheet is decolored even though read processing in the scanner 13 is not completed when a jam occurs in the decoloring unit 20. That is, restoration of data becomes possible by more reliably completing read processing prior to decolorization.

"Decolorization by a decoloring unit" in the embodiment is not limited to decolorization processing which decolors an image formed in a different color from a background color of a sheet by heat. For example, processing of decoloring an image on a sheet by irradiation with light, and processing of decoloring an image formed on a special sheet may also be applied thereto. Alternatively, processing of removing (decoloring) an image on a sheet may be also applied thereto.

That is, "decolorization" may be processing of making an image on a sheet invisible so as to reuse the sheet.

MODIFICATION EXAMPLE

Hereinafter, several modification examples of the above-mentioned embodiment will be described. In the previous embodiment, a sheet type is classified by a basis weight; however, the sheet type may be classified by smoothness of the sheet. As a sheet becomes smooth, a jam is likely to occur in the decoloring unit 20. Thus, the second jam detection time is defined to be relatively long. In the same manner, a sheet type may be classified based on a material of the sheet.

Furthermore, the first jam detection time and the second jam detection time are defined in detail based on a sheet type or the number of decolorization; however, it may be possible to simply define as, for example, "the first jam detection time=the second jam detection time×0.5". That is, as long as a relationship of "the first jam detection time<the second jam detection time" is satisfied, a jam detection condition may be arbitrarily changed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring device comprising:

a decoloring unit configured to decolor an image on a sheet, the image being formed of a decolorable coloring agent;

a scanner positioned on an upstream side of the decoloring unit in a sheet transport direction and configured to optically read the sheet and generate image data corresponding to the read sheet;

a storage unit configured to store a first jam detection time which is a reference time for determining occurrence of a jam of a sheet in a first transport area of a transport path on an upstream side of an inlet of the decoloring unit in the sheet transport direction, and a second jam detection time which is a reference time for determining occurrence of a jam of a sheet in a second transport area of the transport path on a downstream side of the inlet of the decoloring unit in the sheet transport direction of the inlet of the de-coloring unit, the second jam detection time being longer than the first jam detection time, wherein the first jam detection time and the second jam detection time are defined for each of a plurality of types of sheets;

a first sensor configured to detect a sheet being transported in the first transport area;

a second sensor configured to detect a sheet being transported in the second transport area;

a jam determination unit configured to determine occurrence of a jam of a sheet in the first transport area based on a duration of a detection of the sheet by the first sensor compared to the first jam detection time, and determine occurrence of a jam of a sheet in the second transport area based on a duration of a detection of the sheet by the second sensor compared to the second jam detection time; and a sheet type determination unit configured to determine a type of a sheet transported on the transport path, and output a determination result to the jam determination unit.

2. The device according to claim 1, wherein each of the plurality of types of sheets correspond to a predetermined range of weight basis of a sheet, and the sheet type determining unit determines the type of the sheet according to a basis weight of the sheet.

3. The device according to claim 2, wherein the first jam detection time and the second jam detection time are defined to be shorter as the range of basis weight of the sheet type increases until a predetermined upper limit.

4. The device according to claim 3, further comprising:

a decolorization number acquisition unit configured to determine a number of times a sheet has been decolorized based on the image data, and output the determined number of times the sheet has been decolorized, wherein the second jam detection time is defined based on the determined type of the sheet and the determined number of times the sheet has been decolorized.

5. The device according to claim 4, wherein the second jam detection time is defined to be longer as the number of times the sheet has been decolorized for the same type of sheet increases.

6. The device according to claim 1, wherein the sheet type determining unit determines the type of sheet based on a user input.

7. A method of detecting a jam in a decolorization device that includes a decoloring unit configured to decolor an image on a sheet formed of a decolorable coloring agent, and a scanner positioned on an upstream side of the decoloring unit in a sheet transport direction and configured to optically read the sheet and generate image data corresponding to the read sheet, the method comprising the steps of:

acquiring a first jam detection time from a storage unit, the first jam detection time being a reference time for determining occurrence of a jam of a sheet in a first transport area of a transport path on an upstream side of an inlet of the decoloring unit in the sheet transport direction;

acquiring a second jam detection time from the storage unit, the second jam detection time being a reference time for determining occurrence of a jam of a sheet in a second transport area of the transport path on a downstream side of the inlet of the decoloring unit in the sheet transport direction of the inlet of the decoloring unit, the second jam detection time being longer than the first jam detection time;

detecting a sheet being transported in the first transport area with a first sensor or in the second transport area with a second sensor;

determining occurrence of a jam of a sheet in one of the first transport area and the second transport area based on a duration of the detection of the sheet by the first or second sensor compared to the first jam detection time or the second jam detection time; and determining a type of a sheet transported on the transport path, wherein the first jam detection time and the second jam detection time are defined for each of a plurality of types of sheets.

8. The method according to claim 7, wherein each of the plurality of types of sheets correspond to a predetermined range of weight basis of a sheet, and the type of the sheet is determined according to a basis weight of the sheet.

9. The method according to claim 8, wherein the first jam detection time and the second jam detection time are defined to be shorter as the range of basis weight of the sheet type increases until a predetermined upper limit.

10. The method according to claim 9, further comprising:

determining a number of times a sheet has been decolorized based on the image data, wherein the second jam detection time is defined based on the determined type of the sheet and the determined number of times the sheet has been decolorized.

11. The method according to claim 10, wherein the second jam detection time is defined to be longer as the number of times the sheet has been decolorized for the same type of sheet increases.

12. The method according to claim 7, wherein the type of sheet is determined based on a user input.

13. A decoloring device comprising:

a decoloring unit configured to decolor an image on a sheet, the image being formed of a decolorable coloring agent;

a scanner positioned on an upstream side of the decoloring unit in a sheet transport direction and configured to optically read the sheet and generate image data corresponding to the read sheet;

a storage unit configured to store a first jam detection time which is a reference time for determining occurrence of a jam of a sheet in a first transport area of a transport path on an upstream side of an inlet of the decoloring unit in the sheet transport direction, and a second jam detection time which is a reference time for determining occurrence of a jam of a sheet in a second transport area of the transport path on a downstream side of the inlet of the decoloring unit in the sheet transport direction of the inlet of the de-coloring unit, the second jam detection time being longer than the first jam detection time;

at least one sensor configured to detect a sheet being transported in the first transport area;

a second sensor configured to detect a sheet being transported in the second transport area; and a processor configured to control the decoloring unit, control the scanner, control the storage unit, receive a detection result from each of the first and second sensors, determine occurrence of a jam of a sheet in the first transport area based on a duration of a detection of the sheet by the first sensor compared to the first jam detection time, determine occurrence of a jam of a sheet in the second transport area based on a duration of a detection of the sheet by the second sensor compared to the second jam detection time, and determine a type of a sheet transported on the transport path, wherein the first jam detection time and the second jam detection time are defined for each of a plurality of types of sheets.

14. The device according to claim 13, wherein each of the plurality of types of sheets correspond to a predetermined range of weight basis of a sheet, and the processor determines the type of the sheet according to a basis weight of the sheet.

15. The device according to claim 14, wherein the first jam detection time and the second jam detection time are defined to be shorter as the range of basis weight of the sheet type increases until a predetermined upper limit.

16. The device according to claim 15, wherein the processor is further configured to:

determine a number of times a sheet has been decolorized based on the image data, wherein the second jam detection time is defined based on the determined type of the sheet and the determined number of times the sheet has been decolorized.

17. The device according to claim 16, wherein the second jam detection time is defined to be longer as the number of times the sheet has been decolorized for the same type of sheet increases.

* * * * *